United States Patent [19]

Szal

[11] Patent Number: 4,597,930

[45] Date of Patent: Jul. 1, 1986

[54] METHOD OF MANUFACTURE OF A FELTED FIBROUS PRODUCT FROM A NONAQUEOUS MEDIUM

[76] Inventor: John R. Szal, 2 Larisa Ter., Ormond Beach, Fla. 32074

[21] Appl. No.: 512,443

[22] Filed: Jul. 11, 1983

[51] Int. Cl.[4] ..... D21J 5/26; D04H 1/00

[52] U.S. Cl. ..... 264/115; 264/119; 264/121; 264/122; 264/518

[58] Field of Search ..... 264/112, 115, 116, 119, 264/121, 517, 518, 122; 162/187, 182, 72, 63, 70, 25, 26

[56] References Cited

U.S. PATENT DOCUMENTS

| | | | |
|---|---|---|---|
| 2,315,735 | 4/1943 | Richardson | 264/115 |
| 2,757,115 | 7/1956 | Heritage | 264/115 |
| 2,810,940 | 10/1957 | Mills . | |
| 2,964,518 | 12/1960 | Snyder | 162/63 |
| 3,379,719 | 4/1968 | Rulison | 8/196 |
| 3,479,349 | 11/1969 | Corwin et al. | 260/240 |
| 3,616,046 | 10/1971 | Benzinger | 156/306.6 |
| 3,726,756 | 4/1973 | Polak | 162/63 |
| 3,764,451 | 10/1973 | Dunning | 264/119 |
| 3,806,404 | 4/1974 | Liebergott et al. | 162/63 |
| 3,825,381 | 7/1974 | Dunning et al. | 425/83 |
| 3,906,064 | 9/1975 | Ianazzi et al. | 264/24 |
| 4,104,340 | 8/1978 | Ward | 264/112 |
| 4,227,964 | 10/1980 | Kerr et al. | 162/63 |
| 4,248,663 | 2/1981 | Kubes et al. | 162/72 |
| 4,290,988 | 9/1981 | Nopper et al. | 264/112 |
| 4,298,428 | 11/1981 | Breslin et al. | 162/72 |
| 4,302,488 | 11/1981 | Lowi, Jr. | 427/212 |
| 4,324,753 | 4/1982 | Gill | 264/121 |
| 4,404,250 | 9/1983 | Clarke | 156/62.2 |

FOREIGN PATENT DOCUMENTS

| | | | |
|---|---|---|---|
| 43403 | 10/1974 | Japan | 162/72 |

OTHER PUBLICATIONS

"Pulping with Amine and Soda-Amine Systems," L. M. Julien and B. C. H. Sun, Aug. 1979, TAPPI, vol. 62, No. 8, pp. 63-65.

*Primary Examiner*—James Lowe

*Attorney, Agent, or Firm*—Beehler, Pavitt, Siegemund, Jagger & Martella

[57] ABSTRACT

Hydrogen bonding between cellulosic fibriles can be improved in an air-laid process by injecting ammonia or organo-amine catalysts and steam into the cellulosic fibrile mass after such fibers have been reduced to fibrile form and prior to their dispersion in air to form a fibrous mat. Prior to and subsequent to the injection of the catalytic bearing steam, the fibers may be combined with other paper forming material, resins, additives and processed in an air-laid paper making process to form a felted fibrous product with a minimal amount of water content and with acceptable strength and density. Suitable catalysts include gaseous ammonia, ammonium hydroxide, or the organo-amines such as triethanol amine, methyl amine, ethyl amine, cyclohexyl amine, or aniline and the homologous series derivatives thereof.

25 Claims, 1 Drawing Figure

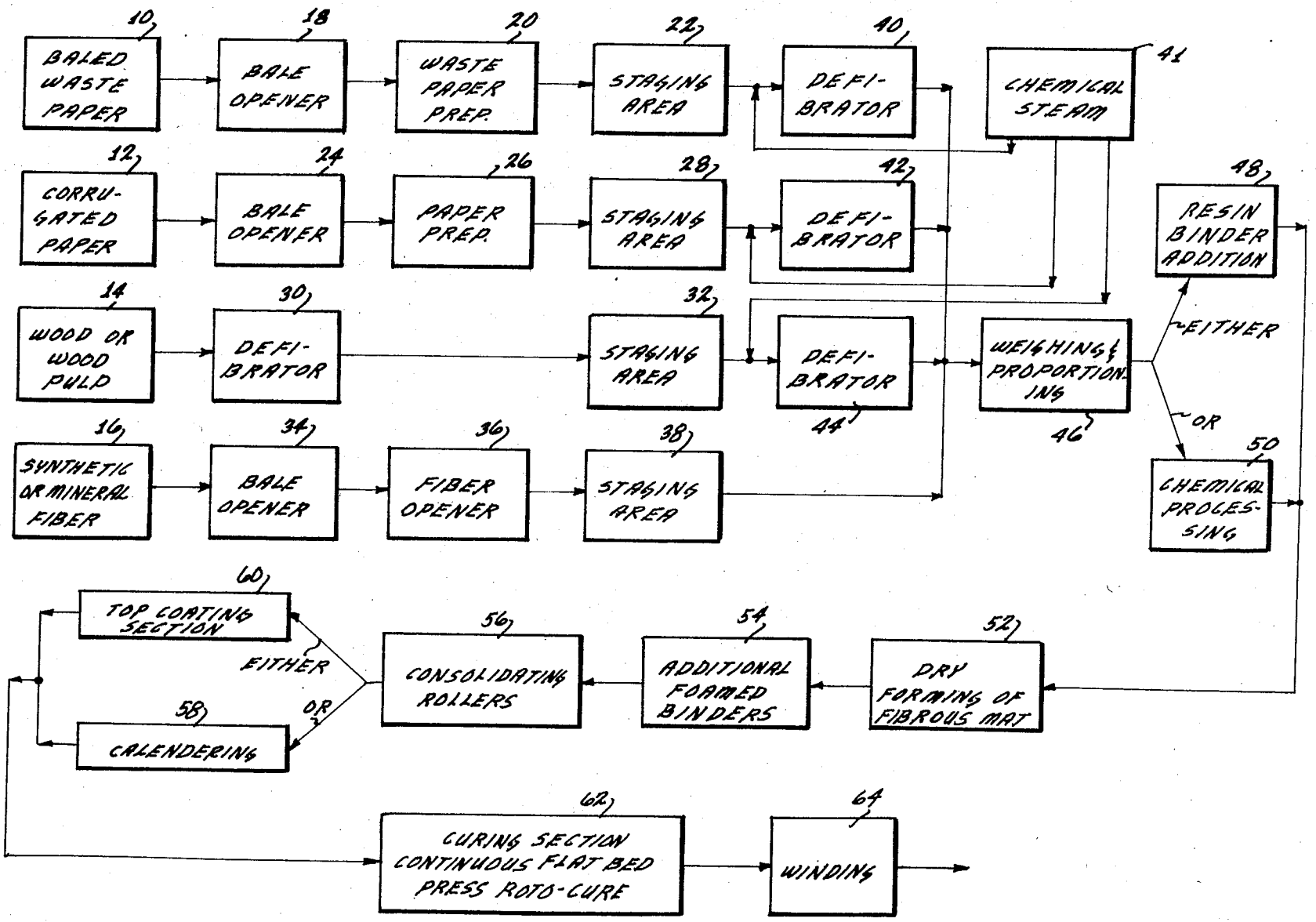
BALED WASTE PAPER
10
BALE OPENER
18
WASTE PAPER PREP.
20
STAGING AREA
22
DEFI-BRATOR
40
CORRU-GATED PAPER
12
BALE OPENER
24
PAPER PREP.
26
STAGING AREA
28
DEFI-BRATOR
42
WOOD OR WOOD PULP
14
DEFI-BRATOR
30
STAGING AREA
32
DEFI-BRATOR
44
SYNTHETIC OR MINERAL FIBER
16
BALE OPENER
34
FIBER OPENER
36
STAGING AREA
38
CHEMICAL STEAM
41
RESIN BINDER ADDITION
48
EITHER
OR
CHEMICAL PROCES-SING
50
WEIGHING & PROPORTION-ING
46
DRY FORMING OF FIBROUS MAT
52
ADDITIONAL FORMED BINDERS
54
CONSOLIDATING ROLLERS
56
TOP COATING SECTION
60
EITHER
OR
CALENDERING
58
CURING SECTION CONTINUOUS FLAT BED PRESS ROTO-CURE
62
WINDING
64

METHOD OF MANUFACTURE OF A FELTED FIBROUS PRODUCT FROM A NONAQUEOUS MEDIUM

BACKGROUND OF THE INVENTION

1. Field of the Invention

The present invention relates to the field of paper manufacture and in particular to air-laid processes.

2. Description of the Prior Art

Traditionally, paper is manufactured by depositing fine fibers in a very dilute suspension in water on a fine mesh screen. The prime prerequisite is a large quantity of water in order to form the dilute suspension. Thereafter, the water is removed by varying types of drying processes all of which ultimately use large amounts of energy. In addition, present environmental considerations no longer allow the dumping of such removed water as waste, but require recirculation. The expended recirculated water must be treated and purified before reuse. This adds to the amount of energy normally required to produce the paper.

Paper formation is generally accomplished by bonding between tiny fibriles on the paper fibers. In the case of celluslosic fibers, paper strength is primarily provided through hydrogen bonding at the points of interfibrile contact. In the case of noncellulosic fibers, such as mineral, glass or plastic fibers, a resin is added to achieve the bonding at the interfibrile contact.

In order to overcome these shortcomings, the prior art has devised methods in which the fibers are dispersed in air and then deposited to form a paper web. However, since there is no or little hydration of cellulosic fibers which are thus air deposited, resultant air-laid mat exhibits very little strength since hydrogen bonding occurs, if at all, to a minimal extent. Therefore, most air-laid papers, even when composed of cellulosic fibers, require the addition of a resin binder to provide interfibrile bonding. One such prior art process is shown by Iannazzi, "PROCESS FOR DRY FORMING PAPER", U.S. Pat. No. 3,906,064, which shows air dispersed fibers introduced into a circulating loop. The fibers are circulated at a predetermined velocity and then withdrawn. Withdrawn fibers are then directed against a paper making wire screen upon which the paper web is formed.

In Mills, "PAPER MANUFACTURE", U.S. Pat. No. 2,810,940, a small amount of moisture is added to the fibers by opening a valve whereupon the fan draws air from over a water tank so that moisture laden air is mixed with the paper stock and the fibers take on the moisture. The air or water may be heated to enhance moisture absorbtion by the fibers. A suction device operates to assist intermingling of the fibers to remove moisture from the paper stock as it is air delivered to the belt. Paper making stock is continuously supplied from a supply vat by a continuously rotating screw onto an endless conveyor belt. A delivery nozzle extends from a housing and terminates in a wide delivery outlet. A Yankee dryer is adjacent to the delivery outlet and to the belt. In addition, pressure rollers are disposed on each side of the belt to press the fiber carried on the belt.

Although not a waterless process, the use of water vapor in a heated air dispersed cellulosic fibers are air-laid upon a mat forming belt and then later dried by suction, and pressing by conventional means. A similar water bearing air-laid process for making paper is discussed by Dunning et al, "APPARATUS FOR FORMING AIR LAID WEBS", U.S. Pat. No. 3,825,381, wherein a water spray is used to wet wood fiber which is air laid and then pressed to form a bonded web.

Thus, the prior art has utilized air-laid fibers in combination with various forms of water spray or moisture laden air in attempt to form the hydrogen bonds between the fibriles. However, the strength of the paper thus formed is still not acceptable for many applications and the amount of moisture which may be added, although less than traditional wet processes, is still great. If substantial hydrogen bonding is to be accomplished, large enough amounts of water are used so that the amount of energy then later required to dry the air-laid paper is still significant.

What is needed, then, is a methodology for the dry manufacture of paper in which a high degree of hydrogen bonding can be obtained in cellulosic fibers with a minimal amount of moisture used in a substantially dry air-laid paper manufacturing process.

BRIEF SUMMARY OF THE INVENTION

The present invention is an improvement in a method of manufacturing felted fibrous produce comprising the steps of reducing cellulosic material to fiber form, mixing a basic substance which includes a radical which in turn includes a nitrogen atom and at least two hydrogen atoms, such as ammonia or ammonium derivatives or organoamines, into the fibers by steam injection in order to hydrate the fibers in preparation for the formation of hydrogen bonds at interfibrile contact points and then air laying the fibriles to form a fibrous mat defining interfiber contact points and thereby to form the hydrogen bonds at the contact points. The fibrous mat is then adaptable for further processing according to conventional methods to form felted fibrous products. One such ammonium derivative compound is ammonium hydroxide and examples of organoamines which can be used as catalysts in the present improved method of dry paper manufacture include aminobenzene (aniline); ethyl amine; triethanol amine, methyl amine, cyclohexyl amine and homologous series members thereof.

These and other features of the invention can better be understood by considering the detailed description in connection with the manufacturing processes shown in the accompanying figure.

BRIEF DESCRIPTION OF THE DRAWINGS

The FIGURE is a diagrammatic block diagram showing a paper manufacturing process illustrating the improved methodology of the present invention.

DETAILED DESCRIPTION OF THE PREFERRED EMBODIMENTS

The present invention is a method of manufacturing air-laid paper or a felted fibrous product, such as paperboard, in which a degree of high hydrogen bonding is obtained between air-laid cellulosic fibers by the use of a catalyst mixed with steam in an air dispersion of fibers. More particularly, such a catalyst includes the use of ammonia gas mixed with steam injected into the fibrile mass as it is being processed and broken up into the fibriles. Such catalysts also include the use of steam injected ammonium derivatives and organo-amines, and their homologous series derivatives. For example, ammonia, ammonium hydroxide, triethanol amine, methyl amine, cyclohexyl amine, ethyl amine, and aniline and the homologous series derivatives of each of them could be used. Any organo-amine in which the terminal group is an amine could probably be beneficially employed.

The present invention and its various embodiments may be better understood by considering the manufacturing process diagrammatically depicted in the Figure. Turning now to the Figure, a plurality of different types of paper stock can be utilized and mixed in various proportions according to well known principles of paper manufacture or may be used singly. For example, baled waste paper is collected at step 10, corrugated paper collected at step 12, wood or wood pulp collected at step 14, and synthetic or mineral fiber collected at step 16. In the case of baled waste paper, the paper is opened at step 18 and then shredded and broken up in a conventional manner at step 20. The paper stock at this point has not yet been reduced to fibriles, but has been shredded as finely as practical prior to defibration. The paper stock is then moved to a preliminary staging area at step 22.

Referring now to the corrugated paper at step 12, the corrugated paper bales are similarly opened at step 24 and then shredded or ground to a fine mass at step 26 before moving to a staging area at step 28, again prior to reduction to a fibrile state.

Similarly, wood or wood pulp collected at step 14 is ground and finely shredded at step 30 or may even be reduced to a fibrile mass before collection at a staging area at step 32.

Synthetic or mineral fiber collected at step 16 is unbaled at step 34, cut, ground, shredded and reduced to a fibrile state by a conventional fiber opener at step 36 prior to collection at a staging area at step 38.

Clearly, the process steps for baled waste paper, corrugated paper, wood or wood pulp, and synthetic or mineral fiber occur independently of or simultaneously with each other. Paper stock derived from these types of sources is devised by conventional means either to a fibrile mass or to a state which is amenable to reduction into a fibrile mass and delivered to a staging area. In the case of baled waste paper, corrugated paper and wood or wood pulp, each of these paper stock materials is cellulosic and amenable to interfibrile bonding through hydrogen bonding. Clearly, other sources of cellulosic fibers could be used as well.

The celluslosic fibers are then subjected to a final fiber reduction at step 40 in the case of baled waste paper, at step 42 in the case of corrugated paper, and at step 44 in the case of wood pulp. However, during the final reduction into the fibrile mass a catalyst is added by means of a steam jet which is thoroughly mixed with the fibrile mass during this final reduction step. According to the present invention, an organo-amine is injected with the steam to catalytically enhance and induce hydrogen bonding between the cellulosic fibriles with a minimal amount of introduced water.

In one embodiment, ammonia, ammonia hydroxide, or aniline is added in gaseous form with the injection of live steam with 1% to 100% saturation or superheated steam in conventional defibrators, such as manufactured by Sprout Waldron, Inc. under the trademark (Disc Refiner 105A). However, according to the invention, many other organoamines could be substituted, including without limitation aniline, cyclohexyl amine, triethanol amine, ethyl amine, methyl amine or any organoamine in which the terminal is an amine as previously stated. Further detail pertaining to the addition of the steam carried catalyst is set forth below in the context of the enumerated examples.

After injection of the catalyst-bearing steam and final reduction of the celluslosic fibers, the various components are weighed in proportion according to well understood manufacturing principles for the production of the desired type of paper or paper product. Weighing and proportioning at step 46 combines the paper masses according to the requirements of the ultimate end product desired. After the paperstock inputs have been weighed and proportioned, they may then be further processed by the addition of a resin binder at the step 48, which will be necessary if high amounts of synthetic or mineral fiber are used which does not form hydrogen bonds between the fibriles. Similarly, the fibriles can be treated if a special purpose paper is to be produced at step 50. Such special purpose papers would include roofing felt, boxboard, and linerboard. The processing steps briefly referenced at steps 48 and 50 are conventional steps and indicate that point in the manufacturing process wherein conventional additives or other preliminary chemical treatment of the fibers may take place.

The prepared fibrile mass is then formed into a dilute air suspension at step 52 using a conventional air-layering device, such as the dry forming mat former manufactured under the trademark "CUROLATOR". The treated fibriles are then evenly distributed across the mat-forming mesh at step 52 and an initial fibrous mat is formed. Additional foamed binders well known to the art, may be added at step 54 for the purpose of resiliency and loft.

The treated, air-laid mat is then pressed by plurality of conventional consolidating rollers at step 56 to squeeze out excess materials which have been added to the mat, including any small amounts of excess water. Whereas in conventional processes, the number of consolidating rollers required to process the paper mat is fairly large, not uncommonly exceeding six in number. The present process can be used with two rollers or less. In addition, whereas prior art consolidating rollers require large amounts of heat be added to effect the drying process, the amount of drying heat required in an air-laid process according to the present invention is less than 15,000 BTU's per ton.

After step 56, the pressed paper mat is either calendared at step 58 in a conventional manner or may be subject to a top coating at step 60, again in a conventional manner to produce plastic or specially coated papers. The calendared or coated paper is then cured at step 62 in a continuous flat bed press or rotary press such as manufactured by Boston Woven Hose under the trademark "ROTOCURE" to provide the final hardening and curing of the processed paper mat. The finished paper is then wound at step 64, if made into a continuous strip, or if made in segments, stacked at step 64 into bales of paper board sheets.

EXAMPLE I

Consider now a specific example wherein paper is made according to the present invention. One hundred pounds of wastepaper and one hundred pounds of wood pulp are reduced to a fibrile mass as discussed in connection with steps 10–22, relating to baled wastepaper, and in connection with steps 14–32 in the case of wood pulp. The reduced fiber masses are then separately loaded into a defibrator at steps 40 and 44, respectively. In the case of the baled waste paper, steam of 100% saturation at 20 psi (absolute) and 228° F. is injected together with gaseous ammonia 20 psi (absolute). Approximately 3 cubic feet of steam and 1 cubic foot of ammonia gas at the stated pressure and temperature are added for each pound of baled wastepaper. Similarly, approximately 3 cubic feet of steam and 1 cubic foot of ammonia gas at the stated pressures and temperature are added for each pound of wood pulp. The fiber mass is reduced to a final fiber form characterized by an average fiber size of inch fiber length. The fiber mass and the injected catalyst are maintained in the defibrators for approximately 60 seconds.

At step 46, 100 parts of baled wastepaper is combined with 100 parts of wood pulp by weight to obtain the desired mixture for kraft paper. No resin is added since the cellulosic components of the kraft paper are entirely bonded by hydrogen bonding induced by the steam injected catalyst and no special chemical preprocessing is required. The combined mass of wood pulp and waste paper fibers are then loaded within the Curolater wherein they are dispersed in an air suspension according to conventional means and formed into a mat approximately 1 inch thick, with a weight of approximately 0.01 pound per square foot. The prepared mat is then pressed by the consolidating rollers at step 56 at 100 psi roller pressure and 200° F. temperature. Prior to consolidation, the approximate of water content within the mat is 15% by weight. After consolidation by the rollers, the average amount of moisture content is 10% by weight. Since kraft paper is not coated, it is calendered in a conventional manner at step 58 by three calendering rollers adjusted at 20 psi roller pressure. The mat is now approximately 0.02 inch thick. Thereafter, the calendered kraft paper is cured at step 62 by air drying over a Yankee dryer. The cured paper which meets ASTM specifications D1305-73A is then wound onto a roll at step 64 as a finished product.

EXAMPLE II

Consider now another example wherein boxboard is made according to the present invention. As before, 100 pounds of waste paper is reduced to a fibrile mass by means of the methodology discussed above in connection with the steps 10–22. The fibrile mass is then loaded into the defibrator at step 40. As before, superheated steam at approximately 10% saturation and 15 psi (absolute) pressure at 300° F. is injected into the defibrator together with amino benzene or aniline at 20 psi (absolute). Approximately 3 cubic feet of steam at the stated temperature and pressure and 0.6 cubic inches (10 cc) of liquid aniline or aminobenzene is added to the fibrile mass in the defibrator for each pound of baled wastepaper. Fibrile mass and the injected catalyst are then maintained within the defibrator for approximately 60 seconds.

Since the boxboard is made only from wastepaper, there are no weighing or proportioning operations at step 46 and no resin binder or further chemical processing is required for boxboard at steps 48 and 50. Therefore, the catalytically treated fibrile mass is taken from step 40 directly to step 52 wherein the fibrile mass is loaded within the CUROLATOR and dispersed in an air suspension to form a mat approximately 1.5 inches thick with the weight of 0.06 pounds per square foot. Similarly, no foam binders are added at step 54 and the prepared mat is taken from the CUROLATOR at step 52 to the consolidating rollers at step 56. There, the prepared mat is pressed by the rollers at approximately 50 psi roller pressure and 200° F. Prior to consolidation at step 56, the approximate water content of the prepared mat is approximately 5% by weight. After consolidation within the rollers at step 56, the average amount of moisture content within the compressed mat remains at approximately 5% by weight. The finished pressed mat is now approximately 0.06 inch thick and is in a condition suitable for cutting and other conventional manufacturing processes well-known in boxboard construction. The finished boxboard meets a Mullen burst test of 35 psi.

EXAMPLE III

In the prior two examples, kraft paper made from wood pulp and baled wastepaper was combined to make kraft paper and boxboard was manufactured solely from wastepaper. In the following example, wastepaper is used according to the present invention to produce roofing felt as the final fabricated product. Starting again, for the purposes of example with 100 pounds of wastepaper in step 10, the wastepaper is reduced to a fibrile mass by using the methodology as discussed in connection with steps 10–22. As before, the fibrile mass is loaded into the defibrator at step 40 and saturated steam at 180 psi (absolute) pressure and 375° F. is injected into the defibrator with triethanol amine and lignin resin. For each pound of wastepaper, approximately 4 cu. feet of steam, 0.6 cu. feet (10 cc) of liquid triethanolamine and 0.25 pound of resin are added and mixed. The fibrile mixture is mixed within the defibrator for approximately 60 seconds.

Meanwhile, 20 pounds of mineral fiber is assembled at step 16 and reduced to a fibrile mass by following the methodology steps in connection with steps 16–38 above. The catalytically treated wastepaper is removed from the defibrator and combined in step 46 with the mineral fiber to form a blended fibrile mass wherein 0.2 pound of mineral fiber, such as glass fiber, is blended with each pound of catalytically treated paper fiber as just described.

According to the present invention, the lignin resin had been added earlier at step 40. In the case of noncellulosic resins, the addition of such resins can be later added at step 48 as well.

The blended fibers are then loaded into a Curolator to form a mat approximately 6 inches thick. The weight of such a mat is again approximately 1.5 pounds per square foot. After the mat is airlaid, it is presented at step 56 to the consolidating rollers and subjected to 50 psi roller pressure at 250° F. Again, no additional foam binders are added for the creation of roofing felt at the intermediate step 54.

Prior to consolidation at step 56, the airlaid mat is characterized by a water content of approximately 10% by weight. After consolidation within the rollers at step 56, the average amount of moisture content is reduced to 8% by weight. Again, in the case of roofing felt, no further coating or calendaring at steps 58 or 60, is required. After curing step 62 and winding step 64 the consolidated roofing felt is now in a condition for conventional processing steps normally practiced within a roofing mill to produce the final product. The tensile strength of the felt is 35 psi in the machine direction and 30 psi transverse thereto. A Mullen burst test of 50 psi is satisfied.

Many modifications and alterations may be made by those having ordinary skill in the art without departing from the spirit and scope of the invention. For example, it is clear in the above three examples that selected ones of the steps as initially described in connection with the Figure can be omitted or combined with other ones of the steps as may be appropriate to the particular felted fibrous product being manufactured. Therefore, the methodology as summarized by the Figure should be understood only as an illustrative example or outline of one combination of process steps and should not be taken as a limitation or restrictive definition within which the invention must be practiced. Furthermore, the above examples are not exhaustive of the variations of process parameters which can be employed to produce kraft paper, boxboard, roofing felt or other felted fibrous products and paper. The proportions, temperatures and pressures recited are set forth only as a means of example to concretely illustrate the invention. The process can clearly be modified to assume other process values according to generally understood design parameters.

Therefore, the invention which is illustrated by the examples as set forth above is defined by the following claims.

I claim:

1. An improvement in a method of manufacturing felted fibrous product including the steps of reducing cellulosic material into fibers, said improvement consisting the steps of:

dispersing said fiber and a substance containing a radical in air, which substance includes a nitrogen atom and at least two hydrogen atoms, injecting said substance in gaseous phase;

ionizing said substance by steam injection while in gaseous phase;

hydrating said fibers while in air suspension in preparation for formation of hydrogen bonds at interfibrile contact points; and air laying said fibers while hydrated to form a fibrous mat defining interfibrile contact points among said fibers, whereby hydrogen bonds are formed at said interfibrile contact points during said step of air laying, said fibrous mat produced thereby being adaptable for further processing to form said felted fibrous product.

2. The improvement of claim 1 wherein said substance is gaseous ammonia.

3. The improvement of claim 1 wherein said substance is ammonium hydroxide.

4. The improvement of claim 1 wherein said substance is an ammonium derivative.

5. The improvement of claim 1 wherein said substance is amino benzene (aniline).

6. The improvement of claim 1 wherein said substance is a homologue of amino benzene (aniline).

7. The improvement of claim 1 wherein said substance is ethyl amine.

8. The improvement of claim 1 wherein said substance is a homologous series compound of ethyl amine.

9. The improvement of claim 1 wherein said substance is triethanol amine.

10. The improvement of claim 1 wherein said substance is methyl amine.

11. The improvement of claim 1 wherein said substance is cyclohexyl amine.

12. The improvement of claim 1 wherein said substance is an organoamine.

13. The improvement of claim 1 wherein said substance is selected from the group of compounds consisting of ammonia, ammonium hydroxide, amino benzene (aniline), ethyl amine, triethanol amine, methyl amine, cyclohexyl amine, and the homologous series derivatives of each of them.

14. The improvement of claim 1 further including the step of mixing noncellulosic material in fiber form with said cellulosic material treated by said substance and then air laying said fibriles to form said fibrous mat.

15. The improvement of claim 1 further comprising the step of consolidating said fibrous mat to form a pressed sheet.

16. In a method for manufacturing a finished felted fibrous product from fibers, of which at least some of said fibers are cellulosic, said method including the steps of preparing a dry pulped mass from said fibers, forming bonds between said fibers, dry forming an intermediate felted fibrous product, and finishing said intermediate filed fibrous product to provide a finished felted fibrous product, an improvement consisting of the steps of:

dispersing said fibers including said cellulosic fibers in an air suspension at least immediately prior to said step of dry forming said intermediate felted fibrous product to steam and a gaseous and ionized substance having a radical which includes a nitrogen atom and at least two hydrogen atoms for a predetermined time to hydrate said cellulosic fibers for later formation of hydrogen bonds at interfibrile contact points; and dry forming said intermediate product while said cellulosic fibers are hydrated, whereby said finished felted fibrous product is manufactured with a minimum of water and therefore a minimal amount of drying to form a final integral mass which is bound, at least in part, by said hydrogen bonds at said interfibrile contact points.

17. The improvement of claim 16 wherein said substance is ammonia.

18. The improvement of claim 16 wherein said substance is an ammonium derivative.

19. The improvement of claim 16 wherein said substance is an organoamine.

20. The improvement of claim 16 wherein said substance is selected from the group consisting of ammonia, ammonium hydroxide, ammonium derivatives, aniline, ethyl amine, methyl amine, triethanol amine, cyclohexyl amine, and homologous series derivatives of each of them.

21. The improvement of claim 1 wherein said substance is selected from the group consisting of ammonia, aniline and tri-ethanol amine.

22. An improvement in a method for manufacturing felted fibrous product, said method comprising the steps of reducing a plurality of types of base materials into fibrous form, at least one of said types of base materials being cellulosic, preparing said cellulosic type of base material in fibrous form to form bonds between fibers of said cellulosic type of base material, mixing said plurality of types of base materials to form a blended fibrous mass, said improvement consisting of the steps of:

dispersing said cellulosic types of base material when in fibrile form in an air suspension;

injecting a substance in gaseous phase including a radical which in turn includes a nitrogen atom and at least two hydrogen atoms at a predetermined temperature and pressure for a predetermined time;

ionizing said substance by said steam injection while said substance is in gaseous phase;

hydrating said cellulosic type of base material with said substance and steam while aid material is dispersed in said air suspension;

dry forming a fibrous mat form said blended fibrous mass from said plurality of types of base materials while said cellulosic type of base material is hydrated; and consolidating said fibrous mat to form a pressed sheet of said plurality of types of materials, whereby said cellulosic type of base material exposed to said substance is induced to form hydrogen bonds at interfibrile contact points between said cellulosic fibers, thereby forming an integral fibrous mass with a minimum of water and drying.

23. An improvement in a method for manufacturing a felted fibrous product, said method comprising the steps of reducing cellulosic material into fibers and air laying said fibers to form a fibrous mat defining interfibrile contact points among said fibers, said improvement consisting of the steps of:

suspending said fibers in an air suspension;

disposing a substance in said air suspension containing a radical, which includes a nitrogen atom and at least two hydrogen atoms;

introducing said substance in gaseous phase in said air suspension;

ionizing said substance while in gaseous phase in said air suspension;

hydrating said fibers with said ionized vapor substance and steam while in said air suspension whereby hydroxyl groups on said cellulosic fibers are activated; and air laying said activated fibers to form a felted product while said fibers are hydrated, whereby hydrogen bonds are formed at said interfibrile contact points and said fibrous mat produced thereby being adaptable for further processing to form said felted fibrous product.

24. The improvement of the method claim 23 where said step of hydrating said fibers and suspending said fibers in air comprises the steps of swelling said fibers by injecting steam into said air suspension of fibers.

25. The improvement of the method of claim 24 where said step of air laying said fibers to form said fibrous mat comprises the steps of permitting volatile fractions to degas from said fibrous mat, whereby swelling of said fibers is decreased thereby tending to bring said interfibrile contact points into close proximity to allow strong molecular attraction between adjacent hydroxyl groups on said cellulosic fibers, and further comprising the step of retaining said radical on said fibers to activate said hydroxyl groups until proximity of said interfibrile contact points is close enough to allow strong influence of molecular attractions of said adjacent hydroxyl groups.

* * * * *